US011084705B1

(12) United States Patent
Kamble et al.

(10) Patent No.: US 11,084,705 B1
(45) Date of Patent: Aug. 10, 2021

(54) BEVERAGE DISPENSER WITH CONSUMABLE MONITORING SYSTEM

(71) Applicant: PepsiCo, Inc., Purchase, NY (US)

(72) Inventors: Rahul Kamble, Haryana (IN); Muhammad Ansari, New York, NY (US); Aleksey Bakharev, Valhalla, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/786,479

(22) Filed: Feb. 10, 2020

(51) Int. Cl.
*B67D 1/08* (2006.01)
*B67D 1/10* (2006.01)

(52) U.S. Cl.
CPC ..... *B67D 1/0888* (2013.01); *B67D 1/102* (2013.01)

(58) Field of Classification Search
CPC ..... B67D 1/1247; B67D 2001/1261; B67D 2001/126; B67D 1/0888; B67D 1/102
See application file for complete search history.

(56) References Cited

U.S. PATENT DOCUMENTS

| | | | | | |
|---|---|---|---|---|---|
| 5,174,722 | A * | 12/1992 | Lybecker | F03C 1/003 | 417/12 |
| 5,601,413 | A * | 2/1997 | Langley | F04B 49/02 | 222/63 |
| 6,053,361 | A * | 4/2000 | Hills | B67D 1/1247 | 222/66 |
| 6,402,478 | B1 * | 6/2002 | Zhang | B67D 1/1247 | 222/23 |
| 2013/0292407 | A1 * | 11/2013 | Beavis | F04B 17/044 | 222/1 |
| 2019/0292037 | A1 * | 9/2019 | Nicol | B67D 1/0881 | |
| 2020/0024119 | A1 * | 1/2020 | McDougall | B67D 1/0882 | |
| 2020/0055720 | A1 * | 2/2020 | Volftsun | B67D 1/0004 | |
| 2020/0156919 | A1 * | 5/2020 | Reichelt | B67D 1/0888 | |
| 2020/0249066 | A1 * | 8/2020 | Gurumohan | B67D 1/0888 | |

* cited by examiner

*Primary Examiner* — Donnell A Long
(74) *Attorney, Agent, or Firm* — Sterne, Kessler, Goldstein & Fox P.L.L.C.

(57) ABSTRACT

A beverage dispenser includes a system for detecting an empty state of a consumable in the dispenser. The system detects the physical movement of an element of a fluid delivery component that is fluidly connected to the consumable. The movement is triggered by the empty state of the consumable and is detected by a sensor disposed in the beverage dispenser. The system can be retrofitted into a legacy beverage dispenser with reduced installation effort.

13 Claims, 3 Drawing Sheets

BEVERAGE DISPENSER WITH CONSUMABLE MONITORING SYSTEM

TECHNICAL FIELD

The present disclosure relates to a system for monitoring the quantity of a consumable in a beverage dispensing system and, in particular, detecting an empty state of the consumable.

BACKGROUND

On-demand beverage dispensers usually include an inventory of consumables that are used to dispense a beverage. These consumables may be pre-made beverages or components of beverages, such as beverage concentrate, that are combined with other ingredients to create the beverage. As beverages are dispensed these consumables are emptied and need to be replaced. However, many dispensers do not have a system for indicating when a consumable is empty. In such dispensers, the first indication of an empty consumable may be when the customer either does not receive their beverage at all (for pre-made beverage consumables) or receives a beverage that is missing an ingredient (for consumables that contain an ingredient of the beverage). This leads to customer dissatisfaction and also makes replacing the consumables more difficult to schedule for a dispenser operator because of the lack of warning from the system. Existing systems for detecting empty consumables are complex, costly, and require significant effort to retrofit to legacy dispensers. Therefore, there exists a need for a simplified system to monitor the empty status of consumables in beverage dispensers.

BRIEF SUMMARY

In embodiment a beverage dispenser includes a housing configured to receive a consumable, wherein the consumable comprises a source of beverage concentrate. A fluid delivery component disposed in the housing is fluidly connected to the consumable and a sensor is connected to the fluid delivery component. The sensor is configured to detect a movement of an element of the fluid delivery component, wherein the movement corresponds to an empty state of the consumable. The sensor is configured to transmit a signal after detecting the movement.

Further embodiments include a system for sensing an empty state of a consumable source in a beverage dispenser that includes a sensor disposed on an exterior of a pump of the beverage dispenser, wherein the consumable source comprises beverage concentrate and wherein the pump is fluidly connected to the consumable source. The sensor is configured to detect a movement of an element of the pump, where the movement corresponds to the empty state of the consumable. The sensor is configured to transmit a signal after detecting the movement and is not in fluid contact with the beverage concentrate.

Embodiments of a method of sensing an empty state of a consumable of a beverage dispenser include detecting a movement of an element of a component of the beverage dispenser using a sensor, wherein the movement corresponds to an empty state of the consumable, and transmitting a signal after detecting the movement.

BRIEF DESCRIPTION OF THE DRAWINGS/FIGURES

The accompanying drawings, which are incorporated herein and form part of the specification, illustrate aspects of the present disclosure and, together with the description, further serve to explain the principles of the disclosure and to enable a person skilled in the relevant art to make and use the disclosure.

DETAILED DESCRIPTION

Figure 1:
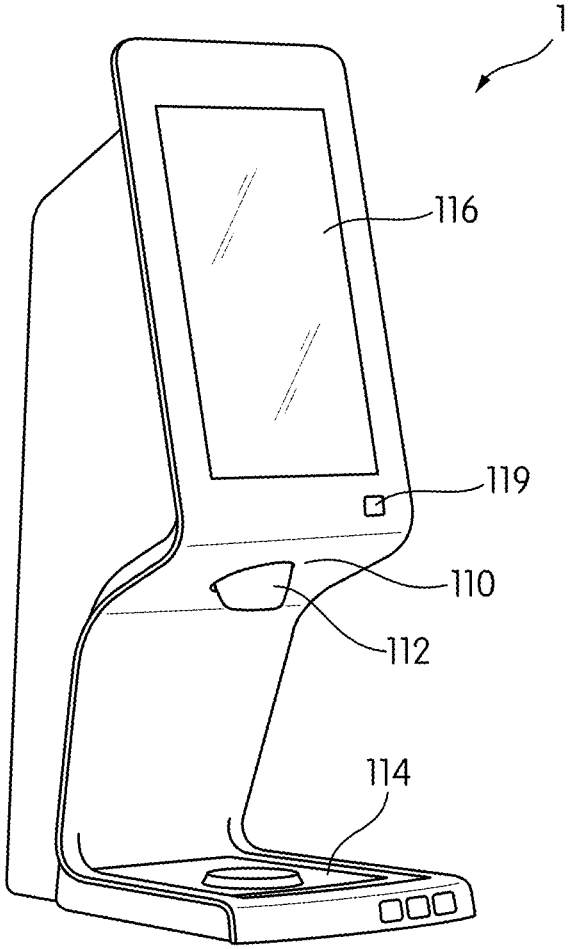
FIG. 1 is a perspective view of a beverage dispenser according to embodiments.

The present disclosure will now be described in detail with reference to embodiments thereof as illustrated in the accompanying drawings. References to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiment whether or not explicitly described.

It is preferable for a beverage dispenser to be capable of notifying the dispenser operator that a consumable of the dispenser is empty and requires replacement. This allows the operator to replace the consumable before there is a disruption in beverage service to consumers. Existing systems that monitor consumable levels are often complex and costly. When they are retrofitted into existing beverage dispensers they usually require more complex installation procedures, including splicing of fluid connections inside the beverage dispenser. Accordingly, there exists a need for an improved consumable monitoring system that can be easily retrofitted into existing legacy dispensers.

In embodiments, a beverage dispenser includes a housing configured to receive a consumable, wherein the consumable comprises a source of beverage concentrate. A fluid delivery component is disposed in the housing and is fluidly connected to the consumable. A sensor is connected to the fluid delivery component. The sensor is configured to detect a movement of an element of the fluid delivery component, where the movement corresponds to an empty state of the consumable. The sensor is configured to transmit a signal after detecting the movement.

In further embodiments, a system for sensing an empty state of a consumable source in a beverage dispenser includes an electromechanical sensor disposed on an exterior of a pump of the beverage dispenser, wherein the consumable source comprises beverage concentrate and wherein the pump is fluidly connected to the consumable source. The sensor is configured to detect a movement of an element of the pump, where the movement corresponds to the empty state of the consumable and is linear. At least part of the element of the pump extends beyond an external surface of the pump after the movement, and the sensor is disposed such that the element physically contacts the sensor after the movement. The sensor is configured to transmit a signal after detecting the movement. The sensor is not in fluid contact with the beverage concentrate.

These and other embodiments of the present disclosure have the advantage of simplified operation and installation because the sensor interfaces with an existing component in the beverage dispenser. Furthermore, in some embodiments, the sensor can be installed without needing to be fluidly connected to the consumable, which further reduces system and installation costs.

As shown in FIG. 1, a beverage dispenser 1 has a housing 100. At least one dispensing station 110 is positioned on a front or consumer-facing side of housing 100. Dispensing station 110 has a dispensing nozzle 112 that is configured to dispense a beverage. A drip tray 114 is positioned below dispensing station 110 and is configured to provide a surface for a container to rest on while the container is being filled. Drip tray 114 may also be configured to catch any excess beverage to reduce mess during beverage dispensing. Beverage dispenser 1 may also have a user interface 116 that is configured to receive an input from a consumer. For example, user interface 116 may include a display screen that is a touch screen. Consumers can use user interface 116 to dispense, and in some case purchase, beverages from beverage dispenser 1. In some embodiments, user interface 116 may include electronic or mechanical buttons or levers that a consumer may press to dispense a beverage. The specific arrangement of the external components of beverage dispenser 1 may be varied as is known in the art without modifying the structure and operation of the embodiments of the present disclosure.

Figure 2:
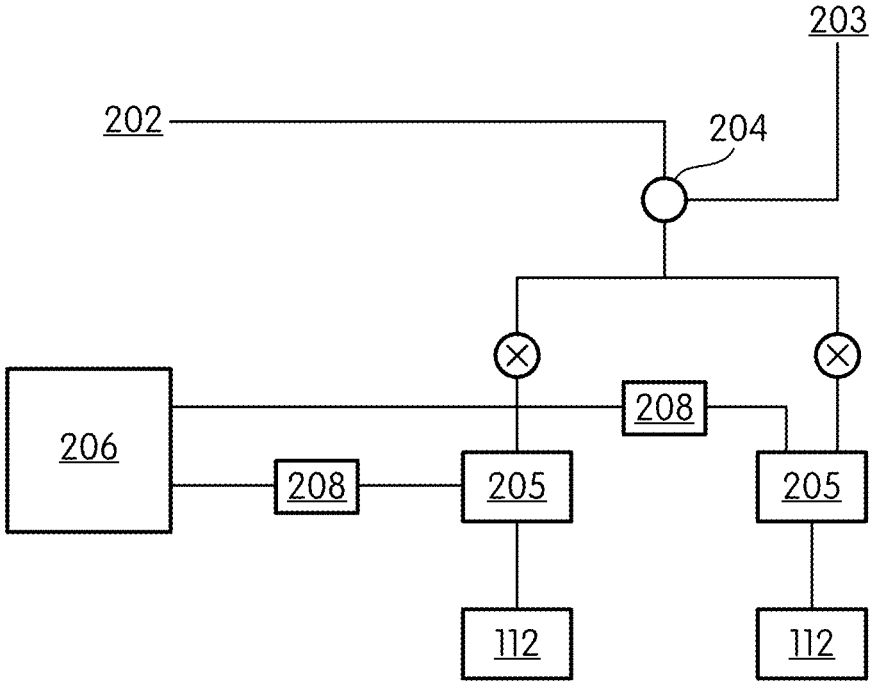
FIG. 2 is a schematic diagram of the fluid connections of a beverage dispenser to embodiments.

A simplified fluid connection schematic of beverage dispenser 1 is shown in FIG. 2. The following components may be disposed inside housing 100 or, alternatively, some of the following components may be disposed remote from housing 100, for example, in a back room. A diluent source 202 enters beverage dispenser 1 from an external source. For example, diluent source 202 may be water taken from the exterior of beverage dispenser, such as from a building water supply. Additional pumps, valves, filters, or other components may be added immediately downstream of diluent source 202 to facilitate and control the intake of diluent to beverage dispenser 1. An optional carbonation source 203 connects with diluent source 203 at a carbonator 204. Carbonator 204 is configured to selectively carbonate diluent 202 as needed to form diluent with the desired level of carbonation. In some embodiments, diluent source 202 may be connected directly to other components of beverage dispenser 1 without being connected to carbonation source 203. Alternatively, diluent 202 may be connected to other components directly and may also connect to other components downstream of carbonator 204. This latter embodiment allows both carbonated and non-carbonated flows of diluent to be accessible to the other components of beverage dispenser 1.

At least one mixing chamber 205 is fluidly connected to diluent source 202. Mixing chamber 205 is configured to receive diluent 202, which may be carbonated, and mix it with one or more beverage ingredients from consumable 206. Consumable 206 is fluidly connected mixing chamber 205. As shown in FIG. 2, in some embodiments a fluid delivery component 208 is fluidly connected between consumable 206 and mixing chamber 205 to enable delivery of the beverage ingredient from consumable 206 to mixing chambers 205. In some embodiments, consumable 206 comprises a fluid beverage concentrate or syrup, and fluid delivery component 208 is a pump configured to pump the beverage concentrate to mixing chamber 205.

In embodiments, as shown for example in FIG. 2, two mixing chambers 205 are present, each connected to consumable 206 through a single fluid connection and fluid delivery component 208. However, in some embodiments consumable 206 may include multiple, separate beverage ingredients. For example, consumable 206 may include several different sources of beverage concentrate, each source having a separate fluid connection to other components of beverage dispenser 1. These sources of beverage concentrate may be stored in known forms of concentrate storage containers, for example, bag-in-box containers or other types of concentrate containers or bottles. In these embodiments each mixing chamber 205 may be fluidly connected to multiple sources of beverage ingredient in consumable 206. Accordingly, each mixing chamber 205 may produce a range of different beverages as needed. In some embodiments, beverage dispenser 1 may be configured to combine different beverage ingredients in one mixing chamber 205 to form customized beverages. Some embodiments of beverage dispenser 1 may only have a single mixing chamber 205 with multiple concentrate connections.

In some embodiments, mixing chamber 205 and consumable 206 may be disposed remotely from housing 100, for example, in a cabinet below a countertop that supports housing 100, or in a separate storage room. In these embodiments piping of the appropriate size fluidly connects mixing chamber 205 with dispensing station 110.

After the beverage ingredient or ingredients have been combined with the diluent in mixing chamber 205, the beverage is dispensed through dispensing station 110. In some embodiments, mixing chamber 205 may be integrated with dispensing station 110, for example, as part of dispensing nozzle 112.

Figure 3:
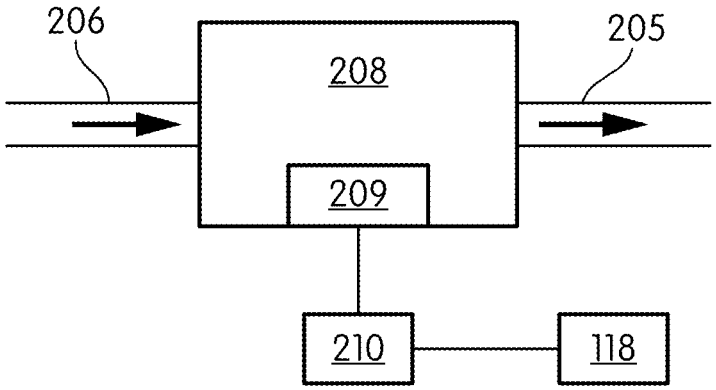
FIG. 3 is a detailed view of a portion of FIG. 2 according to embodiments.

With reference to FIG. 3, a schematic view of a fluid delivery component 208 shows the input from consumable 206 and the output to mixing chamber 205 indicated by the arrows. In some embodiments, fluid delivery component 208 may be a pump configured to pump fluid from consumable 206 to mixing chamber 205. An element 209 is shown as part of fluid delivery component 208 and a sensor 210 is schematically attached to element 209. Element 209 and sensor 210 are discussed further below.

In many beverage dispensers, fluid delivery components 208 are pumps configured to pump beverage concentrate to mixing chamber 205. Typically, these pumps are powered by pressurized gas from carbonation source 203, but they may also be electrically powered, for example. Most pumps used in these situations have a mechanically actuated automatic shut-off feature that activates to turn the pump off when consumable 206 is empty. In the case of a gas powered pump embodiment of fluid delivery component 208, this shut-off feature is configured to detect a certain amount of vacuum on the input of the pump from consumable 206. The present of vacuum means that consumable 206 is empty or nearly empty. The shut-off feature then turns off the pressurized gas input from carbonation source 203. These shut-off features typically include element 209 that functions by physically displacing or moving relative to another part of fluid component 208 to shut down the input power to the pump (e.g. the pressurized gas).

In some embodiments element 209 may move linearly, or along a straight line. In other embodiments element 209 may move along a two-dimensional or three-dimensional curved path. In further embodiments, element 209 may not displace relative to fluid delivery component 208 but instead may rotate without changing its relative position. In some embodiments, at least part of element 209 is disposed on an exterior surface and/or extends beyond an exterior surface of fluid delivery component 208. In other embodiments, element 209 is disposed in the interior of fluid delivery component 208.

Sensor 210 may be mounted to fluid delivery component 208 to detect the movement of element 209. Because element 209 is already present as part of fluid delivery component 208, this means that in some embodiments sensor 210 may be the only physical component (beyond supporting wiring and brackets) that needs to be added to beverage dispenser 1 to detect an empty state of consumable 206.

Sensor 210 may be any type of sensor configured to detect the movement of element 209. For example, sensor 210 may be an electromechanical switch or microswitch, a hall-effect sensor, a reed sensor, a magnetic sensor, or an optical sensor. Some embodiments of sensor 210 may be better suited to detecting different types of movement of element 209. For example, an electromechanical switch may be better suited to detect a linear type of movement of element 209. However, different types of sensors may be adapted to detect the same type of movement as needed. In some embodiments, sensor 210 may be physically connected to element 209, for example through physical linkages such as bars, arms, hinges, sliders, and the like. In other embodiments, sensor 210 may be physically separated from element 209. In some of these embodiments, element 209 and sensor 210 may never come into physical contact and sensor 210 may detect the movement of element 209 through non-physical means (e.g., optically, magnetically, using the hall-effect).

In some embodiments of fluid delivery component 208, element 209 is not fluidly connected to either consumable 206, mixing chamber 205, or carbonation source 203, if applicable. In these embodiments, sensor 210 does not need to be fluidly connected to any component of beverage dispenser 1 to detect movement of element 209. This simplifies installation of sensor 210, especially in retrofit installations, because no fluid-tight connections need to be made during installation.

Sensor 210 may be physical connected to fluid delivery component 208. For example, in some embodiments, sensor 210 is mounted to the exterior of fluid delivery component 208 using a bracket 215. Bracket 215 may be formed in any needed shape and size to position sensor 210 to detect the movement of element 209. Bracket 210 may be fastened to fluid delivery component 208 and sensor 210 using any suitable method, including mechanical fasteners such as screws or bolts, welding, or adhesives. In some embodiments, bracket 215 is an integral part of fluid delivery component 208, which means that it is formed as a seamless part of fluid delivery component 208.

In other embodiments sensor 210 may be integrated internally in fluid delivery component 208. In these embodiments sensor 210 may be mounted directly to any suitable internal structure of fluid delivery component 208. Sensor 210 may still be integrated in such a way as to not be fluidly connected to consumable 206 or mixing chamber 205 in these embodiments. Such a configuration may be preferable to minimize wear on and maintenance of sensor 210.

Sensor 210 is configured to transmit a signal when it detects the movement of element 209. For example, sensor 210 may transmit an electrical signal whenever it detects a certain amount of movement of element 209. In some embodiments, the signal output of sensor 210 may be connected to a controller 118 of beverage dispenser 1. Controller 118 may be configured to read the signal from sensor 210 and display an alert indicating an empty state of consumable 206. In some embodiments, controller 118 may display the alert on user interface 116. In other embodiments, controller 118 may be connected to a separate indicator 119 that can indicate the empty state of consumable 206. In some embodiments, indicator 119 may be a single light disposed on the exterior of beverage dispenser 1. In some embodiments of beverage dispenser 1 with indicator 119, sensor 210 may be directly connected to indicator 119 without requiring any intermediate controller to activate indicator 119.

In any of these embodiments, consumable 206 may comprise multiple separate sources of beverage ingredients. In these embodiments there may be multiple sensors 210 connected to different fluid delivery components 208 corresponding to each separate source of beverage ingredient. Each sensor 210 may transmit an empty signal corresponding to an empty state of one of the sources of beverage ingredient of consumable 206. Each sensor 210 may be connected to controller 118, which may be configured to display a unique alert identifying the empty state of the particular source of beverage ingredient of consumable 206 that is empty. If necessary, multiple alerts may be simultaneously displayed to indicate the empty state of multiple sources of beverage ingredient. In embodiments of beverage dispenser 1 with indicator 119, indicator 119 may comprise multiple lights, each light corresponding to an individual source of beverage concentrate of consumable 206.

In some embodiments, controller 118 may be connected to an external network 120 that enables communication with other devices on the network. For example, controller 118 may be connected to a cellular network or a wireless internet network. In these embodiments, controller 118 may be configured to transmit an alert using external network 120 that indicates an empty state of consumable 206 instead of, or in addition to, activating an alert on user interface 116. The alert may be transmitted, for example, to a device of an operator of the beverage dispenser, such as a personal computer or a mobile device. In this manner controller 118 may directly alert the operator of an empty state of consumable 206.

Figure 4:
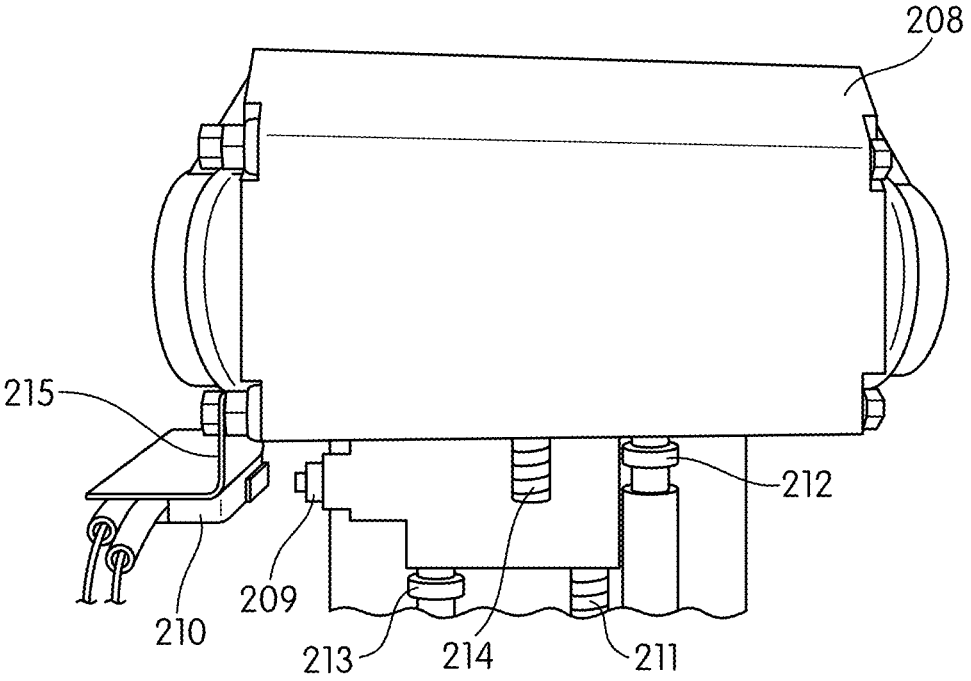
FIG. 4 is a side view of a component of a beverage dispenser according to embodiments.
Figure 5:
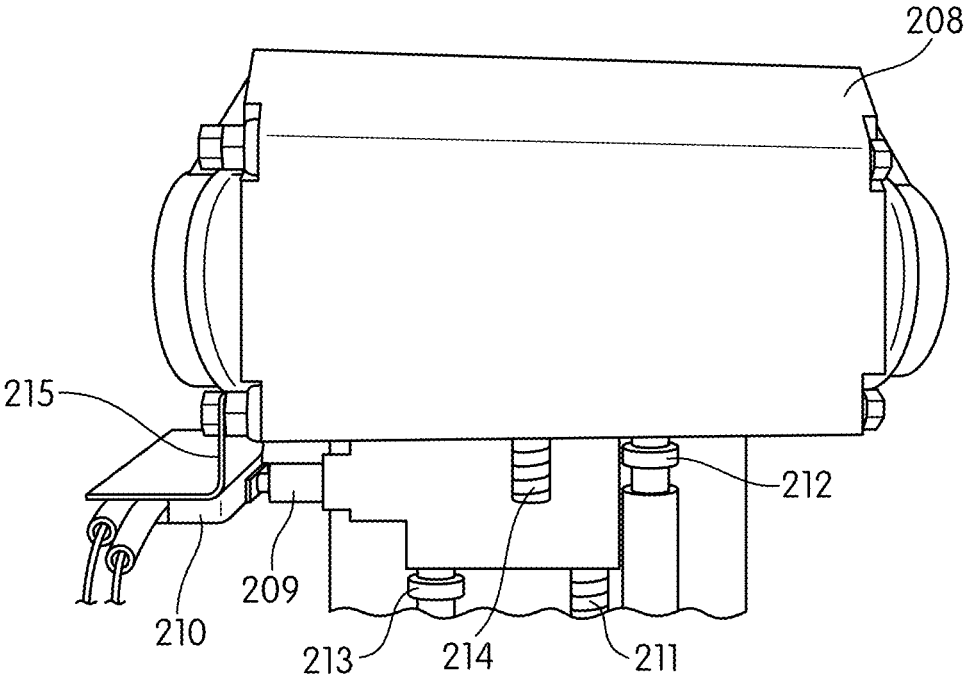
FIG. 5 is a side view of the component of FIG. 4 in a different operating state.

FIGS. 4 and 5 show an embodiment of fluid delivery component 208 that is a pump powered by pressurized gas. A pressurized gas inlet 213 connects fluid delivery component 208 to a pressurized gas source, for example, carbonations source 203. After powering the pump, the gas is released through a pressurized gas outlet 214. A beverage concentrate inlet 211 is fluidly connected to consumable 206. Beverage concentrate is pumped through fluid delivery component 208 and exits a beverage concentrate outlet 212, which may be fluidly connected to mixing chamber 205. Sensor 210 is attached to the exterior of fluid component 208 by bracket 215. In this embodiment, sensor 210 is an electromechanical switch. A portion of element 209 extends beyond the exterior surface of fluid delivery component 208. FIG. 4 shows element 209 retracted rightwards in an operating position that allows fluid delivery component 208 to function as a pump. FIG. 5 shows element 209 extended leftwards in a shut-off position that deactivates fluid delivery component 208. As seen in FIGS. 4 and 5, sensor 210 is positioned such that there is a physical gap between element 209 and sensor 210 in the operating position (in FIG. 4). In the shut-off position, the position of sensor 210 is such that element 209 physically contacts the switch element of sensor 210 and activates sensor 210. Accordingly, sensor 210 senses when element 209 moves into the shut-off position. Sensor 210 is also operatively connected to either controller 118 or indicator 119 as needed to transmit the signal (not illustrated).

A method of operation of an embodiment of the present disclosure includes first reaching an empty state of consumable 206 in beverage dispenser 1. In response to the empty state of consumable 206, element 209 of fluid delivery component 208 moves. Sensor 210 detects the movement of element 209 and transmits a signal after detecting the movement. In some embodiments controller 118 receives the signal and displays an alert indicating the empty state of consumable 206.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure and the appended claims in any way.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A beverage dispenser, comprising:

a housing configured to receive a consumable, wherein the consumable comprises a source of beverage concentrate;

a fluid delivery component disposed in the housing and fluidly connected to the consumable, wherein the fluid delivery component is a pump; and a sensor connected to the fluid delivery component, wherein the sensor is configured to detect a movement of an element of the fluid delivery component, wherein the movement corresponds to an empty state of the consumable, wherein at least a portion of the element of the pump extends beyond an external surface of the pump after the movement, and wherein the sensor is configured to transmit a signal after detecting the movement.

2. The dispenser of claim 1, wherein the sensor is disposed on an exterior of the pump.

3. The dispenser of claim 2, wherein the sensor is connected to the pump without being in fluid contact with the beverage concentrate.

4. The dispenser of claim 1, wherein the movement of the element is linear and wherein the sensor is disposed such that the element physically contacts the sensor after the movement.

5. The dispenser of claim 1, wherein the sensor is selected from the group containing an electromechanical switch, a hall-effect sensor, and a reed sensor.

6. A system for sensing an empty state of a consumable source in a beverage dispenser, comprising:

a sensor disposed on an exterior of a pump of the beverage dispenser, wherein the consumable source comprises beverage concentrate and wherein the pump is fluidly connected to the consumable source, wherein the sensor is configured to detect a movement of an element of the pump, where the movement occurs when the pump detects an empty state of the consumable source, wherein the sensor is configured to transmit a signal after detecting the movement, and wherein the sensor is not in fluid contact with the beverage concentrate.

7. The system of claim 6, wherein at least part of the element of the component extends beyond an external surface of the pump after the movement.

8. The system of claim 6, wherein the movement of the element is linear and wherein the sensor is disposed such that the element physically contacts the sensor after the movement.

9. The system of claim 6, wherein the sensor is selected from the group containing an electromechanical switch, a hall-effect sensor, and a reed sensor.

10. A method of sensing an empty state of a consumable of a beverage dispenser, comprising:

detecting a movement of an element of a component that comprises a pump of the beverage dispenser using a sensor, wherein the movement corresponds to an empty state of the consumable and wherein at least a portion of the element of the component extends beyond an external surface of the pump after the movement, and transmitting a signal after detecting the movement.

11. The method of claim 10, wherein the consumable is a source of beverage concentrate and wherein the component is a pump fluidly connected to the consumable.

12. The method of claim 11, wherein the sensor is connected to the pump without being in fluid contact with the beverage concentrate.

13. The method of claim 10, wherein detecting the movement comprises the element physically contacting the sensor such that a portion of the sensor moves with respect to the sensor.

* * * * *